US008665165B1

(12) United States Patent
Chen et al.

(10) Patent No.: US 8,665,165 B1
(45) Date of Patent: Mar. 4, 2014

(54) BROAD BEAM WAVEGUIDE FEED AND REFLECTOR ANTENNA EMPLOYING SAME

(75) Inventors: Ming H. Chen, Rancho Palos Verdes, CA (US); Chia-Hung Wang, Taipei (TW)

(73) Assignee: Victory Microwave Corporation (TW)

( * ) Notice: Subject to any disclaimer, the term of this patent is extended or adjusted under 35 U.S.C. 154(b) by 795 days.

(21) Appl. No.: 12/762,322

(22) Filed: Apr. 17, 2010

(51) Int. Cl.
*H01Q 13/00* (2006.01)

(52) U.S. Cl.
USPC ..... 343/781 R; 343/772

(58) Field of Classification Search
USPC ..... 343/781 R, 700 MS, 772
See application file for complete search history.

(56) References Cited

U.S. PATENT DOCUMENTS

| | | | | |
|---|---|---|---|---|
| 5,359,339 | A * | 10/1994 | Agrawal et al. | 343/786 |
| 2002/0113746 | A1 * | 8/2002 | Strickland | 343/786 |
| 2005/0231436 | A1 * | 10/2005 | McLean et al. | 343/786 |

* cited by examiner

*Primary Examiner* — Dameon Levi
*Assistant Examiner* — Graham Smith
(74) *Attorney, Agent, or Firm* — Clifford Perry

(57) ABSTRACT

An improved waveguide feed includes a ridged waveguide section and a feed section. The ridged waveguide section includes a wall structure and spaced-apart opposing ridges disposed on an internal surface of the wall structure, with the spaced-apart opposing ridges extending along a major axis of the wall structure. The feed section is coupled to the ridged waveguide section, and includes an extension of only a portion of the wall structure of the ridged waveguide section, and an extension of the spaced-apart opposing ridges disposed on an internal surface of the extended wall structure of the feed section.

8 Claims, 6 Drawing Sheets

BROAD BEAM WAVEGUIDE FEED AND REFLECTOR ANTENNA EMPLOYING SAME

BACKGROUND

The present invention relates to feed structures for antennae, and more particularly to a waveguide feed structure and reflector antennae using same.

FIG. 1A illustrates a conventional reflector antenna 100 having a waveguide feed 120 which uses a waveguide bend 130 to feed the reflector 140 at the focal point of the reflector.

FIG. 1B illustrates conventional E- and H-plane radiation patterns for the waveguide feed 120. A typical radiation pattern for the antenna 100 is defined as the range over which the antenna 100 provides a gain of −10 dB relative to a 0 dB signal at the antenna boresight. This selection is weighted by the balance of aperture efficiency and the spill over loss. Referring to the radiation patterns of FIG. 1B, the energy of the antenna feed from ±53° (total 106°) intersects the reflector 140, but the energy from 53-180° is lost in space, such loss referred to as "spill over loss," as known in the art, such loss reducing the antenna's efficiency, or effective collection area. Moverover, the spill over loss generates unwanted sidelobes which can further interfere with the desired transmission/reception of the intended signal.

FIG. 2 illustrates an improved reflector antenna 200 operable to attenuate unwanted sidelobes. The improved antenna 200 includes the waveguide feed 120 the waveguide bend 130 and the reflector 140 described above, these components enclosed within a housing formed by a signal-transparent radome 220 and absorbing walls 230 located on the periphery of the reflector 140 which operate to attenuate the spill over energy to decrease the generation of sidelobes. While the sidelobe rejection of this antenna is improved, the resulting structure is large and heavy, and may not be suitable in particular environments, e.g., in high wind environments.

FIG. 3 illustrates another improved reflector antenna as disclosed in U.S. Pat. No. 7,075,492 which also has improved sidelobe rejection and does not require the absorber sidewalls as the prior art antenna of FIG. 2. This antenna employs a waveguide feed 320 which operates to illuminate a deep contour reflector over a wide radiation pattern range of ±97° (total 194°). The improved reflector antenna 300 is small and light weight, however the antenna exhibits a relatively large taper/roll off in its aperture field distribution, e.g., 14-20 dB roll off between a signal on boresight versus a signal at the reflector's edge. As a consequence, the antenna 300 has a low aperture efficiency.

What is therefore needed, is an improved waveguide antenna feed and antenna assembly which provides advantages over the aforementioned.

SUMMARY

The present invention presents an improved waveguide feed and reflector antenna employing the improved feed which is small and provides a wide and relatively uniform radiation pattern. In an exemplary embodiment, the improved waveguide feed includes a ridged waveguide section and a feed section. The ridged waveguide section includes a wall structure and spaced-apart opposing ridges disposed on an internal surface of the wall structure, with the spaced-apart opposing ridges extending along a major axis of the wall structure. The feed section is coupled to the ridged waveguide section, and includes an extension of only a portion of the wall structure of the ridged waveguide section, and an extension of the spaced-apart opposing ridges disposed on an internal surface of the extended wall structure of the feed section.

These and other features of the invention will be better understood in view of the following drawings and detailed description of exemplary embodiments of the invention.

For clarity, previously-defined features retain their reference indices in subsequent drawings.

DETAILED DESCRIPTION OF EXEMPLARY EMBODIMENTS

Figure 1A:
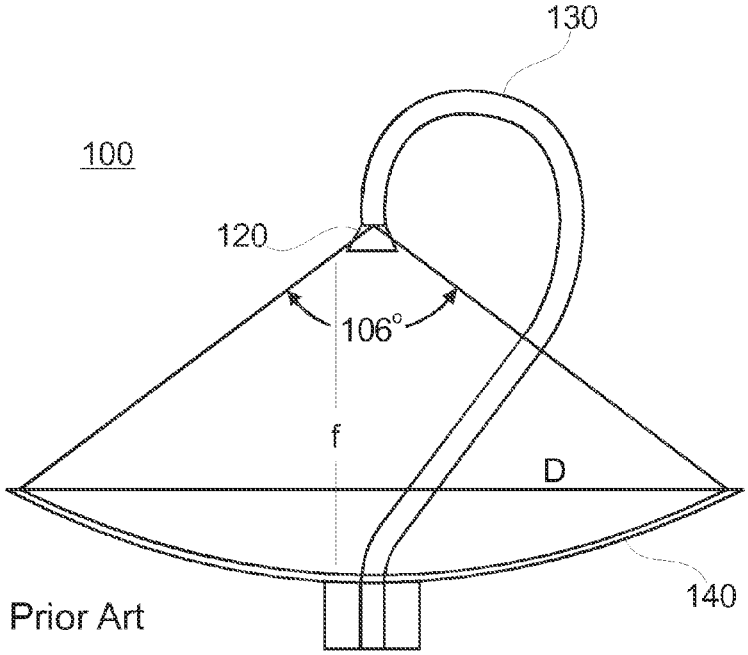
FIGS. 1A and 1B illustrate a conventional parabolic reflector antenna and corresponding E- and H-plane radiation patterns as known in the prior art.
Figure 1B:
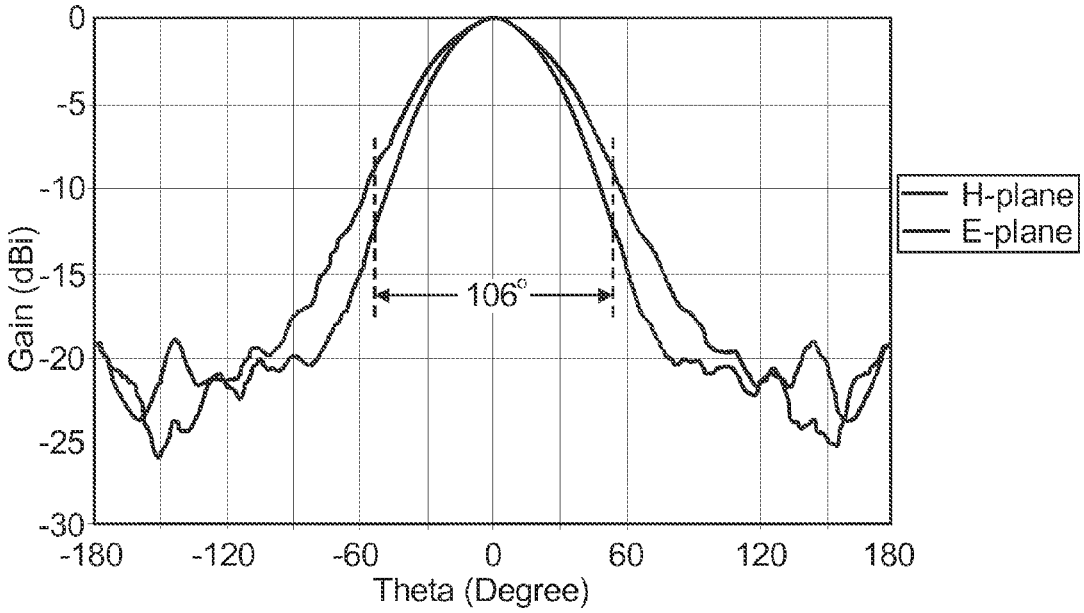
Figure 2:
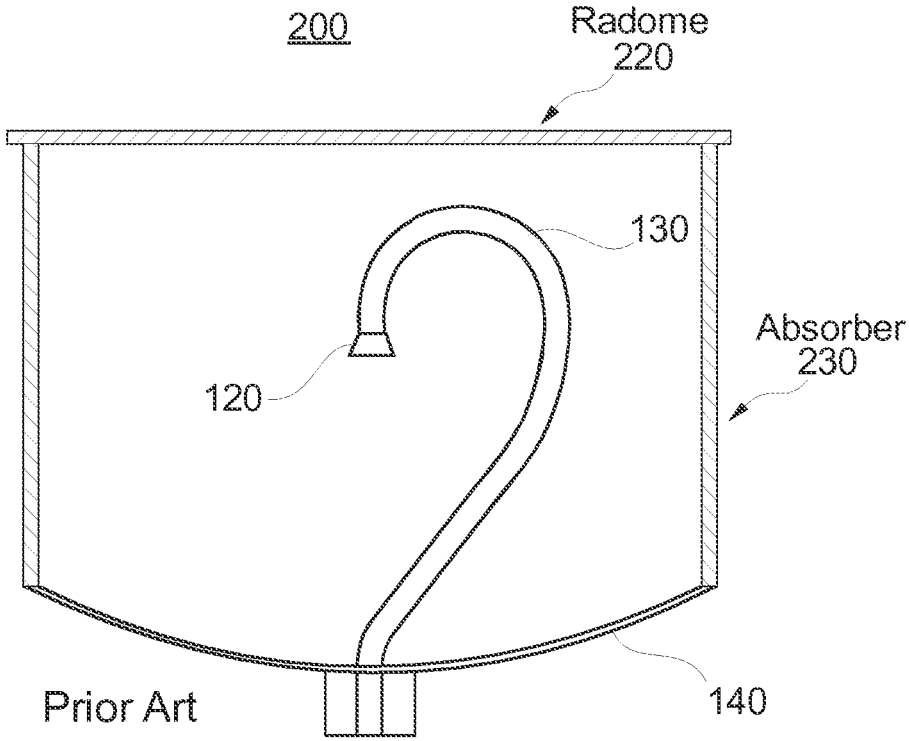
FIGS. 2 and 3 illustrate improved reflector antennae known in the prior art.
Figure 3:
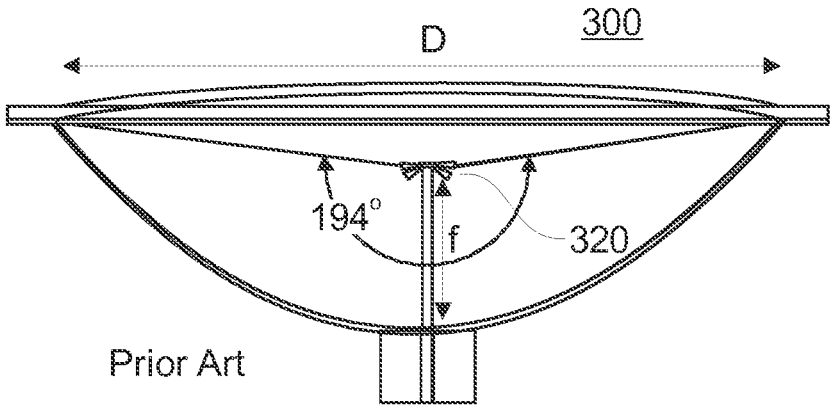
Figure 4A:
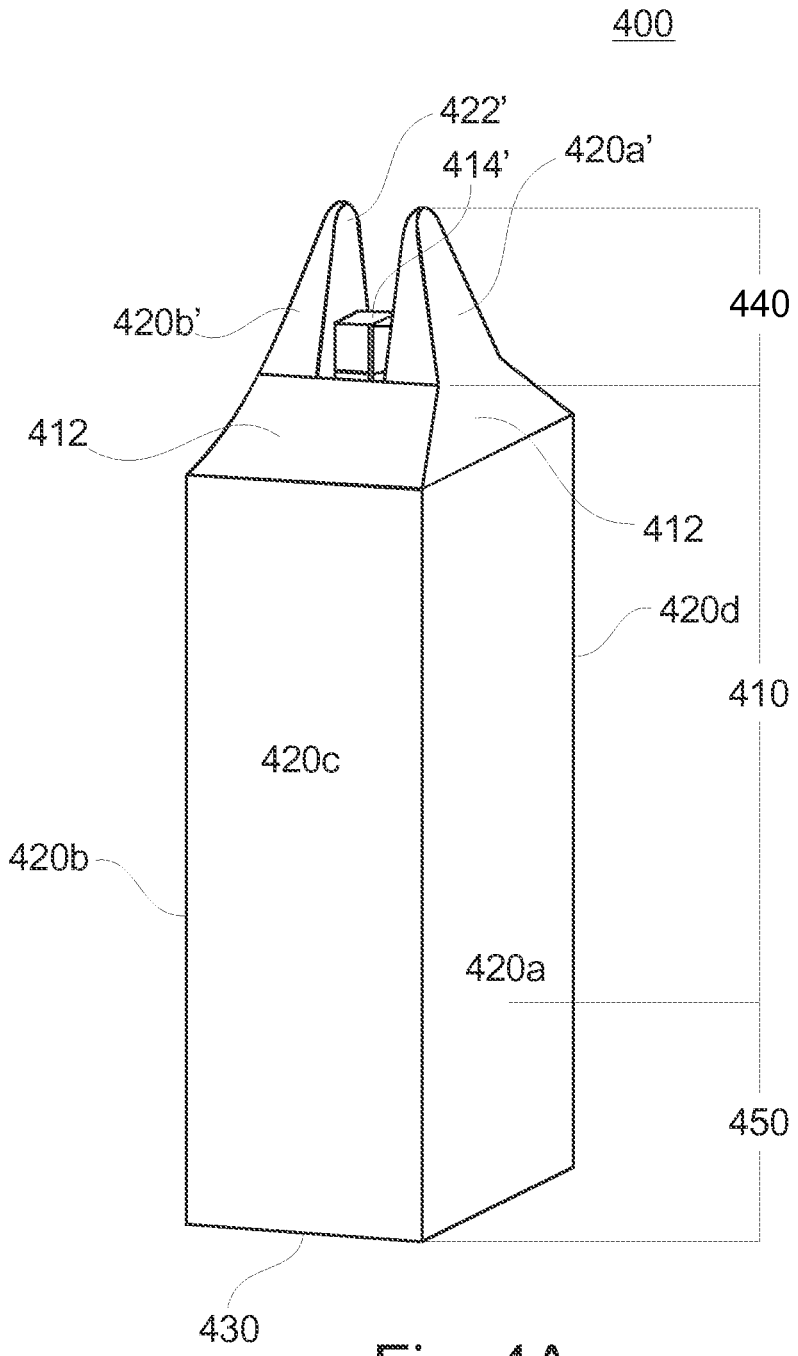
FIGS. 4A-4C illustrates several views of an improved waveguide feed in accordance with the present invention.
Figure 4B:
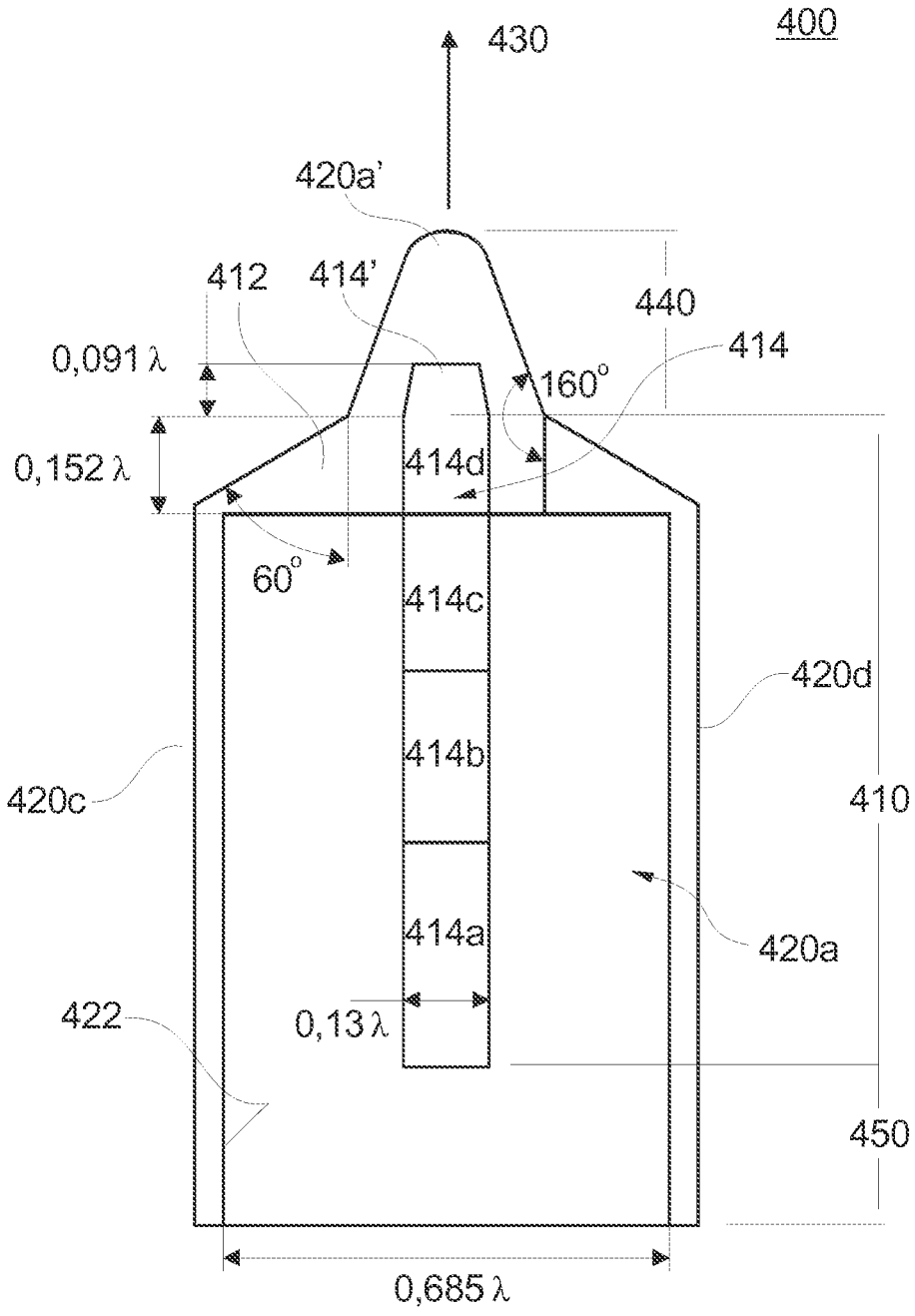
Figure 4C:
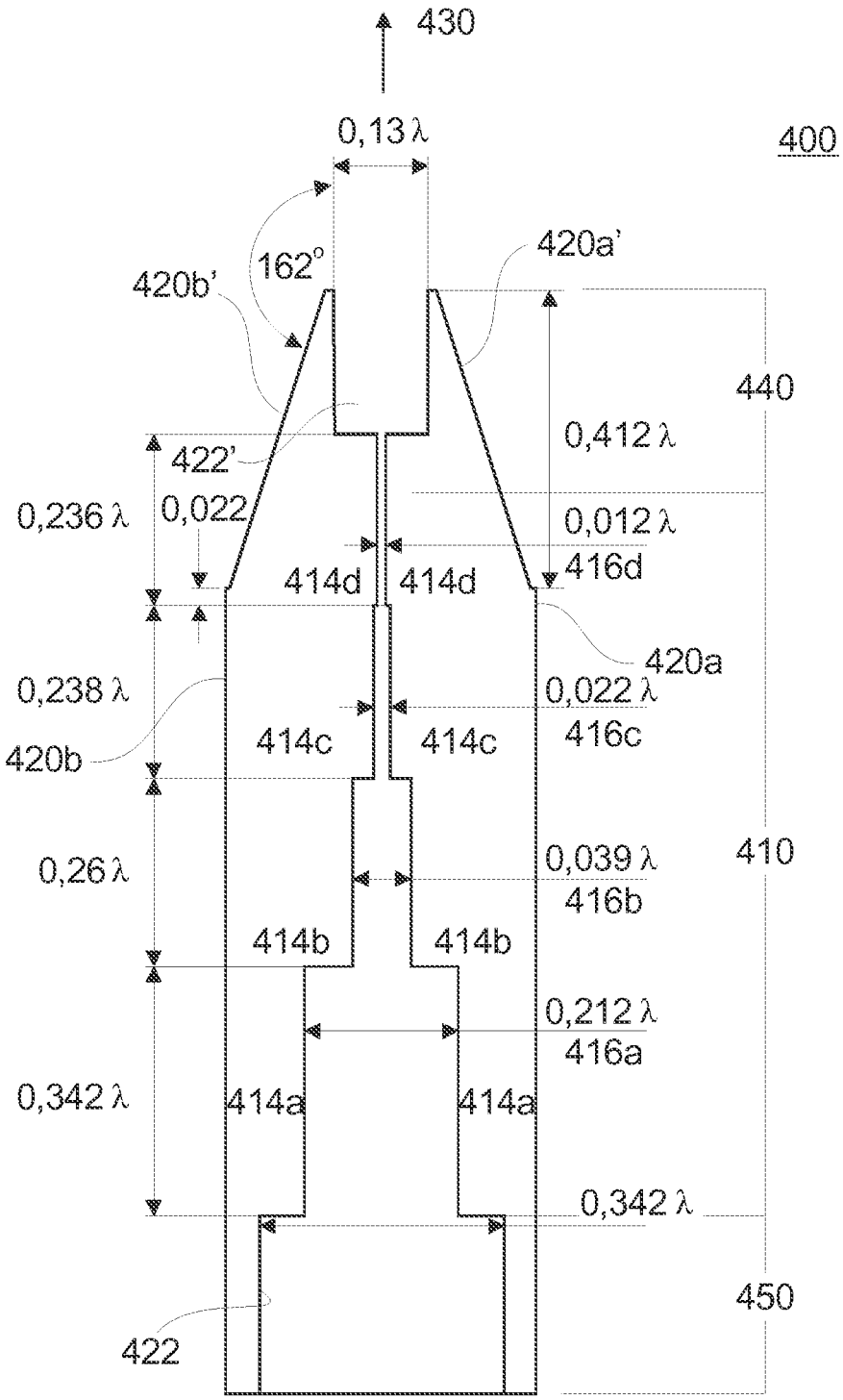

FIGS. 4A-4C illustrate several views of an improved waveguide feed 400 in accordance with the present invention. The improved waveguide feed 400 includes a ridged waveguide section 410 and a feed section 440. The ridged waveguide section 410 includes a wall structure 420 (collectively, 420*a*-420*d*) and spaced-apart opposing ridges 414 disposed on an internal surface 422 of the wall structure 420, the spaced-apart opposing ridges 414 (collectively, 414*a*-414*d*) extending along a major axis 430 of the wall structure 420, the major axis 430 defining the axis of signal propagation through into/out of) the waveguide feed 400.

The feed section 440 is coupled to the ridged waveguide section 410 and includes (a) an extension 420'(collectively 420a' and 420b') of only a portion of the wall structure 420 of the ridged waveguide section 410, and (b) extended spaced-apart opposing ridges 414' disposed on an internal surface 422' of the extended wall structure 420'. Exemplary of feature (a), a portion of the wall structure 420 is not extended to the feed section 440, such that the feed section 440 omits a portion of the wall structure 420 included within the ridged waveguide section 410. In the illustrated embodiment shown, the feed section 440 comprises two walls 420*a*' and 420b' which are formed by extending two walls 420*a* and 420*b* of the ridged waveguide section 410 into the feed section 440. In an alternative embodiment, a different number (e.g., one, three, or four) of walls may be extended into the feed section 440. Further alternatively, only a portion of a wall is extended to the feed section 440, thus forming a slotted wall of the feed section 440, the feed section 440 including one or more of such slotted walls.

The illustrated ridged waveguide section 410 is rectangular in shape and includes four walls 420*a*-420*d*. Waveguides having cross-sectional shapes other than a rectangle may be employed alternatively, for example, a circular or elliptical waveguide, in which case the waveguide would include one wall. In the illustrated embodiment, the ridged waveguide section 410 is coupled to a rectangular waveguide section 450 for providing a received signal to (or to receive the signal from) front end electronics of a receiver (or a transmitter), not shown. In an alternative embodiment, the waveguide section 450 may be of another cross-sectional shape, for example, a circular or elliptical waveguide.

Further exemplary of the improved waveguide feed 400, the spaced-apart opposing ridges 414 may be composed of multiple sections 414*a*-414*d* (as shown in FIGS. 4B and 4C), whereby each section includes a different separation distance 416*a*-416*d* between the spaced-apart opposing ridges 414*a*-414*d*. Further exemplary, the separation distances 416*a*-416*d* are successively smaller as the ridged waveguide section 410 extends toward the feed section 440, as shown in FIG. 4C. In operation, sections 414*a*-414*c* operate as matching elements for transitioning between ridged waveguide section 414*d* and the rectangular waveguide section 450. Still further exemplary, the spaced-apart opposing ridges 414' of the feed section 440 have a tapered width which becomes narrower as they extend distally away from the ridged waveguide section 410, as shown in FIG. 4B.

In one embodiment of the invention, the two extended walls 420*a*' and 420b' of the feed section 440 are tapered in width, thickness, or both. FIG. 4B illustrates a tapering of each wall's width to a narrower width as the wall extends distally away from the ridged waveguide section 410. FIG. 4C illustrates a tapering of each wall's thickness to a narrower thickness as the wall extends distally away from the ridged waveguide section 410.

In a particular embodiment, the improved waveguide feed 400 is operable within any frequency band, for example, the L-band, S-band, C-band, X-band, Ku-band, K-band, and Ka-band. Accordingly, the dimensions provided herein would be in terms of the wavelength of a signal operating at substantially center frequency of that frequency band. In a particular embodiment, the waveguide feed and reflector antenna are employed in a point to point/multipoint communication link.

Figure 5:
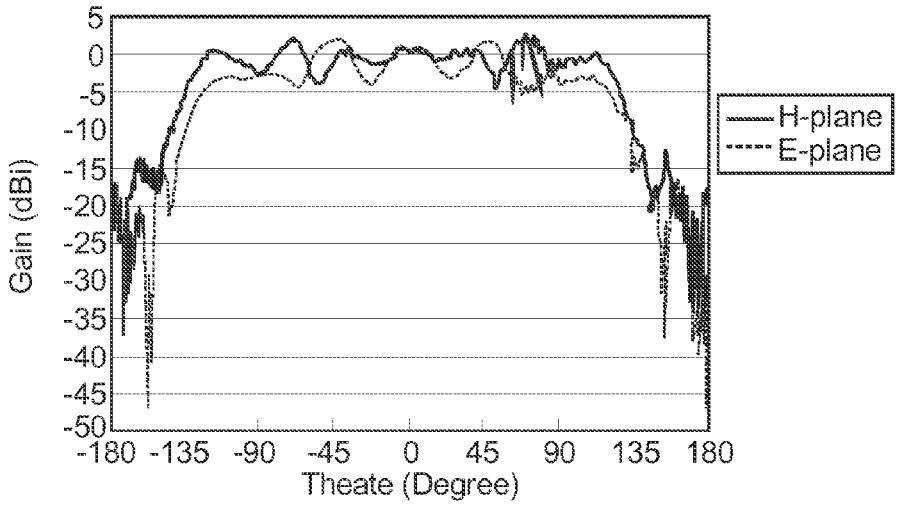
FIG. 5 illustrates E- and H-plane radiation patterns for the improved waveguide feed shown in FIGS. 4A-4C.

FIG. 5 illustrates a radiation pattern for the improved waveguide feed shown in FIG. 4A. As can be seen, the improved waveguide feed provides a relatively uniform radiation pattern over approximately 240 degrees of coverage.

Figure 6A:
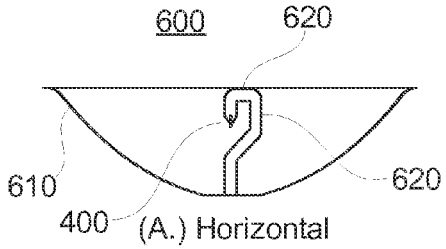
FIGS. 6A and 6B illustrate respective horizontal and vertical planes of a reflector antenna employing the improved waveguide feed shown in FIG. 4A-4C.
Figure 6B:
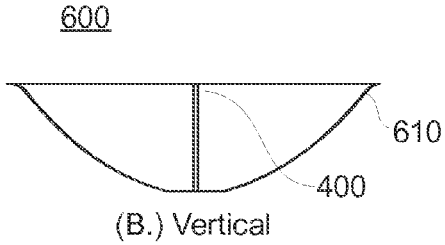

FIGS. 6A and 6B illustrate respective vertical and horizontal planes of a reflector antenna 600 for transmitting/receiving vertically-polarized signals using the improved waveguide feed shown in FIG. 4A. The reflector antenna 600 of FIG. 6A includes a reflector 610 having an F/D ratio of 0.23, and the improved waveguide feed 400 located at the focal point of the reflector 610. A feeding waveguide may include bends 620 to locate the waveguide feed 400 at the proper focal position and orientation. When bends are required, the waveguide feed 400 may be integrated within a single structure which includes the waveguide bends 620, using, for example, CNC machining techniques.

Figure 7A:
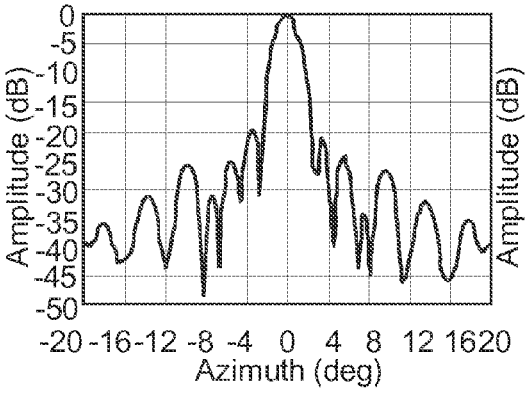
FIGS. 7A and 7B illustrate far field radiation patterns for respective horizontal and vertical planes of the reflector antenna shown in FIGS. 6A and 6B.
Figure 7B:
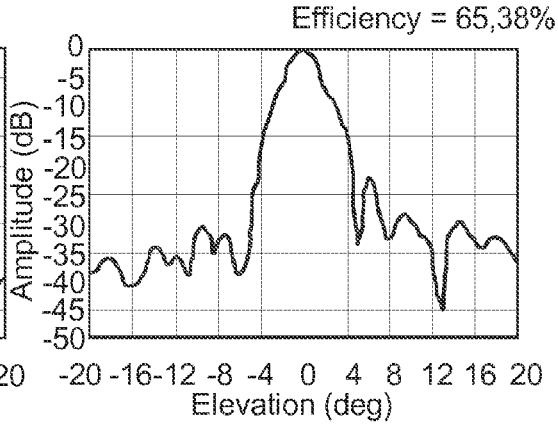

FIGS. 7A and 7B illustrate far field radiation patterns for the vertical and horizontal planes of the reflector antennae shown in FIGS. 6A and 6B, respectively. An aperture efficiency of 65.38% is obtained, and good radiation performances with low sidelobes are also observed. This data indicates that the impact of waveguide bends near the feed is not significant.

The terms "a" or "an" are used to refer to one, or more than one feature described thereby. Furthermore, the term "coupled" or "connected" refers to features which are in communication with each other, either directly, or via one or more intervening structures or substances. The sequence of operations and actions referred to in method flowcharts are exemplary, and the operations and actions may be conducted in a different sequence, as well as two or more of the operations and actions conducted concurrently. The described features are not limited only to their implementation in the exemplary embodiment described therefor, and the skilled person will appreciate that these features can be implemented in the other described embodiments of the invention as well. Reference indices (if any) included in the claims serve to refer to one exemplary embodiment of a claimed feature, and the claimed feature is not limited to the particular embodiment referred to by the reference indicia. The scope of the clamed feature shall be that defined by the claim wording as if the reference indicia were absent therefrom. All publications, patents, and other documents referred to herein are incorporated by reference in their entirety. To the extent of any inconsistent usage between any such incorporated document and this document, usage in this document shall control.

The foregoing exemplary embodiments of the invention have been described in sufficient detail to enable one skilled in the art to practice the invention, and it is to be understood that the embodiments may be combined. The described embodiments were chosen in order to best explain the principles of the invention and its practical application to thereby enable others skilled in the art to best utilize the invention in various embodiments and with various modifications as are suited to the particular use contemplated. It is intended that the scope of the invention be defined solely by the claims appended hereto.

What is claimed is:

1. A waveguide feed, comprising:

a ridged waveguide section comprising a wall structure and spaced-apart opposing ridges disposed on an internal surface of the wall structure, the spaced-apart opposing ridges extending along a major axis of the wall structure; and a feed section coupled to the ridged waveguide section, the feed section comprising (a) an extension of a portion of the wall structure of the ridged waveguide section, and (b) an extension of the spaced-apart opposing ridges disposed on an internal surface of the extended wall structure, wherein the extended portion of the wall structure of the ridged waveguide section is disposed over the extended portion of the spaced-apart opposing ridges, wherein the ridged waveguide section comprises a rectangular waveguide section, and wherein the wall structure comprises four walls, wherein the feed section comprises two walls which extend from a corresponding two walls of the four walls of the wall structure of the ridged waveguide section, wherein the two extended walls of the feed section are tapered, and wherein (i) the wall thickness of each of the two extended walls is tapered from a larger thickness proximate to the ridged waveguide section to a smaller thickness distal from the ridged waveguide section, or (ii) the wall width of each of the two extended walls is tapered from a broader width proximate to the ridged waveguide section to a narrower width distal from the ridged waveguide section.

2. The waveguide feed of claim 1, wherein the spaced-apart opposing ridges comprise multiple sections, wherein each section comprises a different separation distance between the spaced-apart opposing ridges, and wherein the separation distances are successively smaller for sections more proximate to the feed section.

3. The waveguide feed of claim 1, wherein the ridged waveguide section comprises a tapered section adjacent to the feed section, whereby the four walls form a progressively narrower ridged waveguide section extending toward the feed section.

4. The waveguide feed of claim 1, wherein the extended spaced-apart opposing ridges disposed on the internal surface of the extended wall structure of the feed section has a tapered width which becomes narrower as the extended spaced-apart ridges extend distally from the ridged waveguide section.

5. A reflector antenna, comprising:

a reflector having a focal point, and a waveguide feed, comprising:

a ridged waveguide section comprising a wall structure and spaced-apart opposing ridges disposed on an internal surface of the wall structure, the spaced-apart opposing ridges extending along a major axis of the wall structure; and a feed section coupled to the ridged waveguide section, the feed section comprising (a) an extension of a portion of the wall structure of the ridged waveguide section, and (b) an extension of the spaced-apart opposing ridges disposed on an internal surface of the extended wall structure, wherein the extended portion of the wall structure of the ridged waveguide section is disposed over the extended portion of the spaced-apart opposing ridges, wherein the ridged waveguide section comprises a rectangular waveguide section, and wherein the wall structure comprises four walls, wherein the feed section comprises two walls which extend from a corresponding two walls of the four walls of the wall structure of the ridged waveguide section, wherein the two extended walls of the feed section are tapered, and wherein (i) the wall thickness of each of the two extended walls is tapered from a larger thickness proximate to the ridged waveguide section to a smaller thickness distal from the ridged waveguide section, or (ii) the wall width of each of the two extended walls is tapered from a broader width proximate to the ridged waveguide section to a narrower width distal from the ridged waveguide section.

6. The reflector antenna of claim 5, wherein the spaced-apart opposing ridges comprise multiple sections, whereby each section comprises a different separation distance between the spaced-apart opposing ridges, and wherein the separation distances are successively smaller for sections more proximate to the feed section.

7. The reflector antenna of claim 5, wherein the ridged waveguide section comprises a tapered section adjacent to the feed section, whereby the four walls form a progressively narrower ridged waveguide section extending toward the feed section.

8. The reflector antenna of claim 5, wherein the extended spaced-apart opposing ridges disposed on the internal surface of the extended wall structure of the feed section has a width which is tapered to a narrower width distal from the ridged waveguide section.

* * * * *